US005118289A

United States Patent [19]

Bergman et al.

[11] Patent Number: 5,118,289

[45] Date of Patent: Jun. 2, 1992

[54] HOT-ISOSTATIC HIGH-PRESSURE PRESS

[75] Inventors: Carl Bergman, Västerås; Lars Ohlsson, Helsingborg, both of Sweden

[73] Assignee: Asea Brown Bovari AB, Västerås, Sweden

[21] Appl. No.: 640,159

[22] Filed: Jan. 11, 1991

[30] Foreign Application Priority Data

Jan. 15, 1990 [SE] Sweden ..... 9000127

[51] Int. Cl.[5] ..... F27B 5/04

[52] U.S. Cl. ..... 432/205; 432/206; 425/78; 419/25

[58] Field of Search ..... 432/205, 206, 203; 425/78; 419/25

[56] References Cited

U.S. PATENT DOCUMENTS

| | | | |
|---|---|---|---|
| 3,565,410 | 2/1971 | Scherff | 432/205 |
| 3,622,135 | 11/1971 | Bauer | 432/205 |
| 4,131,419 | 2/1978 | Isaksson . | |
| 4,151,400 | 4/1979 | Smith, Jr. et al. | 432/206 |
| 4,280,807 | 7/1981 | Smith, Jr. et al. | 432/205 |
| 4,325,694 | 4/1982 | Bergman | 432/205 |
| 4,756,680 | 7/1990 | Ishii . | |
| 4,802,654 | 2/1979 | Bozhko et al. | 432/206 |
| 4,921,666 | 5/1990 | Ishii . | |

*Primary Examiner*—Henry C. Yuen

*Attorney, Agent, or Firm*—Watson, Cole, Grindle & Watson

[57] ABSTRACT

A hot-isostatic press adapted for rapid cooling of the hot zone after completed pressing and sintering of the material includes a pressure vessel, end closures, and a hot zone surrounded by thermal barriers. Between the thermal barriers and the pressure vessel with end closures there are colder spaces. At least one connection, located in the lower part of the thermal barrier and provided with a valve between the space next to the pressure vessel and the space below the bottom thermal barrier, is provided with an externally controllable valve. In the upper part of the thermal barrier there is an opening with a relatively large cross section and a valve is provided for the opening, which comprises a heat-insulated portion.

8 Claims, 1 Drawing Sheet

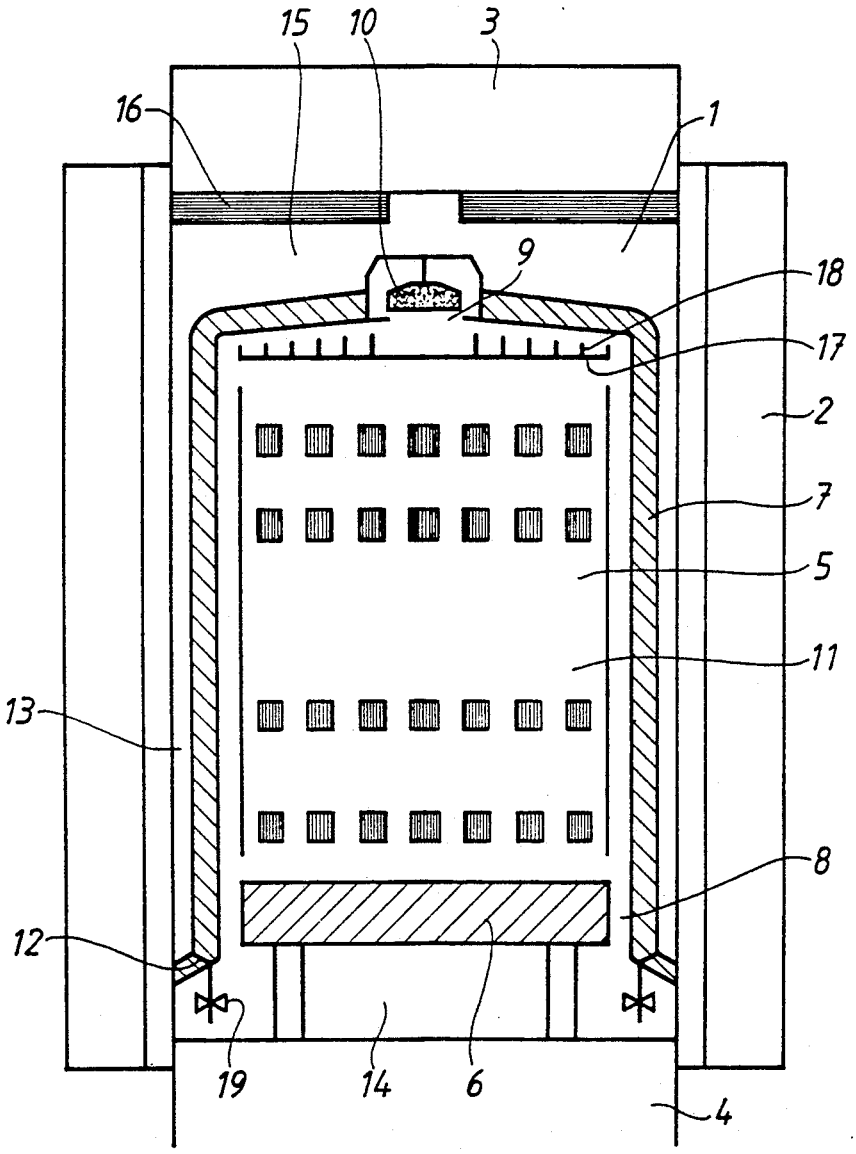
15
10
3
16
1
9
18
17
2
7
5
11
13
8
12
19
14
6
4

HOT-ISOSTATIC HIGH-PRESSURE PRESS

TECHNICAL FIELD

The invention relates to the field of hot-isostatic presses (HIPs) adapted for rapid cooling of the load after a completed press cycle.

BACKGROUND ART

Hot-isostatic presses (HIPs) adapted for rapid cooling of the load after pressing are known. Such a HIP comprises a pressure vessel in which is arranged a hot zone surrounded by heaters and a thermal barrier. The walls of the pressure vessel are cooled to prevent harmful heating of the pressure vessel. This is utilized when cooling the load in such a way that a circulation loop is produced between the hot zone and the space between the outside of the thermal barrier and the inside of the cooled vessel wall by providing the thermal barrier with at least one opening at the bottom and top, respectively, of the hot zone. Additional cooling of the gas may be achieved by allowing the gas to pass through a heat exchanger, heat-absorbing bodies or the like. To prevent gas circulation during the press cycle, it is known to provide the openings at the bottom or the top with an externally controllable valve (see, e.g. SE 7605887-4). A type of HIP, a so-called modular HIP, for example according to EP 145 417, in which a furnace chamber is placed in a movable chamber, may be provided with an externally controllable valve in both the upper and lower openings in the thermal barrier sealing the furnace chamber during heating and transport outside the pressure vessel. When the chamber is installed in the furnace vessel, the upper valve is opened to allow pressurization to take place.

During the pressing it is important to achieve a uniform temperature in the hot zone to obtain the desired properties of the material. Openings in the thermal barrier and open valves mean that colder gas falls into the hot zone during the press cycle and cools parts of the load. This has resulted in a limitation of the size of the openings provided in the thermal barrier.

During the cooling phase, however, the aim is to achieve a considerable gas circulation which provides rapid cooling. Therefore, it has entailed difficulties to combine requirements for high temperature uniformity during the pressing and a high cooling rate after the pressing.

SUMMARY OF THE INVENTION

According to the invention, a hot-isostatic press (HIP) comprises a pressure vessel with a load carrying hot zone surrounded by heaters and thermal barriers. Between the thermal barriers and the pressure vessel and its end closures there are spaces in the press which contain pressure gas which is colder than the gas in the hot zone. In the lower part of the press at least one connection is provided through the thermal barrier between the colder space next to the pressure vessel and the hot zone or the space below the bottom thermal barrier, which communicates with the hot zone. At each connection through the lower part of the thermal barrier, a valve is arranged which is controllable from the outside of the HIP. Further, a relatively large opening is provided in that part of the thermal barrier which is located above the hot zone, which allows large gas quantities to rapidly circulate through the hot zone during cooling. For this opening a valve is arranged which is provided with a heat-insulating layer or the like to prevent the valve from constituting a cooling surface in the hot zone. The valve may be adapted such that it is opened by the convection current which arises when the valve in the lower part of the thermal barrier is opened. Another embodiment may be a heat-insulated valve at the top of the thermal barrier which is controlled from the outside of the press. For such an embodiment the lower part of the thermal barrier may be open, allowing free communication of gas in the lower part. An additional embodiment may comprise the upper part of the thermal barrier being movable and being raisable upon cooling so that gas may pass out from the hot zone.

It is also possible to have one or more openings in the top of the thermal barrier such that the total cross-section area of the openings is large enough for a large cooling flow. Each opening should be provided with a heat-insulated valve. The invention makes possible, in a hot-isostatic press, a great temperature uniformity in the hot zone during the pressing and sintering phase and that the subsequent cooling of the material may take place very rapidly by allowing a large quantity of cooled gas to pass through the hot zone. The relatively large cross section of the opening or openings in the upper part of the thermal barrier permits large gas quantities to pass out from the hot zone, and, consequently, the cooling can be performed considerably more rapidly than earlier. Further, because the opening is provided with a heat-insulated valve, the pressing and sintering phase may be carried out without being adversely affected by inflowing colder gas or cooling surfaces in the thermal barrier.

The invention will be described in greater detail with reference to the accompanying schematic figure, which shows a cross section of a hot-isostatic press adapted for rapid cooling of the hot zone.

The figure shows a cross section of a hot-isostatic press 1 comprising a pressure vessel 2 provided with end closures 3, 4. The load carrying hot zone 5 is surrounded by a thermal barrier 7 and a bottom thermal barrier 6. Between the thermal barriers and the vessel wall and the end closures, respectively, there are colder spaces 13, 14, 15. At least one connection 12 is arranged in the lower part of the thermal barrier 7 between the space 13 next to the vessel wall and the space 14 below the bottom thermal barrier. The connection 12 is provided with a valve 19 which is controllable from the outside of the hot-isostatic press. The space 14 is connected to the hot zone via a gap 8. The location of the connection 12 through the thermal barrier with the valve 19 may be made in a plurality of ways. In the upper part, above the loading space 11 in the hot zone, the thermal barrier 7 is provided with an opening 9, the total cross-section area of the opening being relatively large. A ratio of the cross sections of the opening and the hot zone should be at least 0.003. For example, for a hot zone with an inner diameter of 1250 mm, the opening should be at least 70 mm. For the opening 9, a valve 10 is arranged. The valve 10 comprises a plate, cone or the like which is provided with a heat-insulating layer so that the valve body for the opening should not constitute a cooling portion. This can be made in several different ways; for example, a valve body may comprise a porously sintered ceramic surrounded by a metal sheet or a graphite plate or the like. It is important that the valve be resistant to erosion since large gas quantities flow past the valve during the cooling phase. The valve 10 may be arranged so as to open without mechanical arrangements by the influence of the convection current which arises when the valve 19 in the connection 12 is opened. The valve may, of course, be provided with a guide means, a stop means and the like.

At the bottom of the press chamber, a fan or the like may be arranged which distributes the colder inflowing gas at the bottom. The space 15 above the barrier may house a heat-absorbing body, a heat exchanger or the like 16 for cooling the gas before it makes contact with the pressure vessel wall 2 and is additionally cooled during the passage in the gap 13 and then reenters the hot zone 5 via the connection 12. It is also possible to allow the circulating gas to pass via a pump, a fan or the like in order to increase the flow rate still further.

The insulated valve 10 or the upper part of the thermal barrier 7 may be provided with an open channel or the like to bring about pressure balancing between the hot zone and the space outside the thermal barrier during the pressing and sintering phase when the valves 19 and 10 are closed. To prevent cold gas from rushing in through the pressure balancing channel and cooling the material, a horizontal sheet or the like 17 may be arranged in the upper part of the hot zone. The sheet 17 may be provided with transverse sheet strips or the like 18. Cold gas penetrating into the hot zone will thereby accumulate on the horizontal sheet between the transverse strips and be heated before being mixed with the warm gas in the hot zone.

In another embodiment of the invention, the valve 10 in the upper part of the thermal barrier is made gas-tight and its opening function is controlled from the outside of the press. For such an embodiment, the lower part of the thermal barrier can be open, providing free communication of gas between the space 13, next to the pressure vessel, and the space 14 below the bottom thermal barrier and the hot zone 5.

We claim:

1. A hot-isostatic press (HIP) which comprises lateral pressure vessel walls; opposite top and bottom end closures; a thermal barrier and a bottom thermal barrier located between said lateral pressure vessel walls and between said top and bottom end closures to define a hot zone therewithin, said thermal barrier having a top portion through which extends a gas flow opening and a lower portion which defines a channel means therethrough, an upper space being provided between the top portion of said thermal barrier and said top end closure, a lateral space being provided between said thermal barrier and said lateral pressure vessel walls and a bottom gas space being provided between said bottom thermal barrier and said bottom end closure; an insulated cover for opening and closing said opening in said top portion of said first thermal barrier to control gas flow from said hot zone to said upper space; a valve means in said channel means which is operable from outside of said press to control the flow of cool gas from said lateral space into said hot zone and a horizontal sheet having a plurality of transverse sheet strips positioned in an upper portion of said hot zone to prevent cool gas from falling down on a workpiece in a lower portion of said hot zone.

2. A hot-isostatic press (HIP) according to claim 1, wherein said insulated cover includes a channel therethrough to enable pressure balancing between said hot zone and said upper space.

3. A hot-isostatic press (HIP) according to claim 1, wherein said insulated cover can be lifted to open said gas flow opening by convection current which occurs when said valve means is opened.

4. A hot-isostatic press (HIP) according to claim 1, including means located outside said press for moving said insulated cover.

5. A hot-isostatic press (HIP) which comprises lateral pressure vessel walls; opposite top and bottom end closures; a thermal barrier and a bottom thermal barrier located between said lateral pressure vessel walls and between said top and bottom end closures to define a hot zone therewithin having a cross-sectional area, said thermal barrier having a top portion through which extends a gas flow opening having a cross-sectional area and a lower portion which defines a channel means therethrough, the ratio of cross-sectional area of said hot zone to that of said opening being at least 0.003, an upper space being provided between the top portion of said thermal barrier and said top end closure, a lateral spaced being provided between said thermal barrier and said lateral pressure vessel walls and a bottom gas space being provided between said bottom thermal barrier and said bottom end closure; an insulated cover for opening and closing said opening in said top portion of said first thermal barrier to control gas flow from said hot zone to said upper space; and a valve means in said channel means which is operable from outside of said press for controlling the flow of cool gas from said lateral space into said hot zone.

6. A hot-isostatic press (HIP) according to claim 5, wherein said insulated cover includes a channel therethrough to enable pressure balancing between said hot zone and said upper space.

7. A hot-isostatic press (HIP) according to claim 5, including a horizontal sheet positioned in an upper portion of said hot zone to prevent cool gas from falling down on a workpiece in a lower portion of said hot zone.

8. A hot-isostatic press (HIP) according to claim 5, wherein said insulated cover can be lifted to open said gas flow opening by convection current which occurs when said valve means is opened.

* * * * *